US005619010A

United States Patent [19]

Holm et al.

[11] Patent Number: 5,619,010

[45] Date of Patent: Apr. 8, 1997

[54] METHOD AND AN APPARATUS FOR SPREADING WARHEADS

[75] Inventors: Anders Holm, Karlskoga; Jan Axinger, Storfors, both of Sweden

[73] Assignee: Bofors AB, Karlskoga, Sweden

[21] Appl. No.: 530,110

[22] PCT Filed: Mar. 17, 1994

[86] PCT No.: PCT/SE94/00233

§ 371 Date: Sep. 26, 1995

§ 102(e) Date: Sep. 26, 1995

[87] PCT Pub. No.: WO94/23266

PCT Pub. Date: Oct. 13, 1994

[30] Foreign Application Priority Data

Mar. 30, 1993 [SE] Sweden ..... 9301039

[51] Int. Cl.[6] ..... F42B 12/58

[52] U.S. Cl. ..... 102/489; 102/357; 102/377; 102/393; 89/1.11

[58] Field of Search ..... 102/340, 342, 102/351, 357, 374, 377, 393, 489, 476; 89/1.11

[56] References Cited

U.S. PATENT DOCUMENTS

| | | | |
|---|---|---|---|
| 3,095,814 | 7/1963 | Jansen et al. . | |
| 3,698,320 | 10/1972 | Cochran et al. . | |
| 4,172,407 | 10/1979 | Wentink | 102/489 |
| 4,372,216 | 2/1983 | Pinson et al. | 102/489 |
| 4,455,943 | 6/1984 | Pinson et al. | 102/489 |
| 4,494,437 | 1/1985 | Von Maydell | 89/1.11 |
| 4,616,567 | 10/1986 | Romer et al. | 102/489 |
| 4,625,646 | 12/1986 | Pinson | 102/489 |
| 4,903,605 | 2/1990 | Dupuis . | |
| 5,088,416 | 2/1992 | Sabranski | 102/517 |
| 5,315,933 | 5/1994 | Paulsson et al. . | |

FOREIGN PATENT DOCUMENTS

| | | | |
|---|---|---|---|
| 2671621 | 7/1992 | France | 102/489 |
| 468568 | 8/1993 | Sweden . | |

*Primary Examiner*—Harold J. Tudor
*Attorney, Agent, or Firm*—Pollock, Vande Sande & Priddy

[57] ABSTRACT

An apparatus and method for separating a warhead to be delivered to a target from a carrier missile flying at high speed in a first aerodynamic trajectory include a rocket motor attached to the warhead in the carrier missile and an ejection tube positioned obliquely in the carrier missile rearwardly and upwardly with respect to a longitudinal axis of the carrier missile from which the warhead is ejected by the rocket motor into a second aerodynamic trajectory having a substantially higher maximum flight altitude then the first trajectory. The warhead is separated from the rocket motor after ejection by aerodynamic forces created from the angle of the ejection of the warhead from the carrier missile and the relative flight velocities of the warhead and the carrier missile. The aerodynamic forces act on a connection between the rocket motor and the warhead, whereby the motor and warhead upon the burnout of the motor follow separate forward trajectories upon separation.

8 Claims, 4 Drawing Sheets

METHOD AND AN APPARATUS FOR SPREADING WARHEADS

BACKGROUND OF THE INVENTION

The present invention relates to a method and an apparatus for transforming a war head from a first state under which it forms a part of a larger unit for capsule flying in an aerodynamic trajectory such as, for example, a cruise missile, into a second state under which it follows its own ballistic ejection trajectory in more or less the same major direction but at a substantially higher maximum flight altitude. Such modification of the flight path as entails a change from having been a pair of a larger unit which follow one aerodynamic trajectory into following its own ballistic ejection trajectory may be desirable when it is a matter of spreading, from a capsule, a large number of warheads so that these together cover a predetermined surface area at ground level. Warheads relevant in this context could be, for example, mines, impact-detonated so-called subcombat units of the hollow charge type or more sophisticated constructions such as combat units of a general type which are described in European patent application No. 0252036 (or corresponding U.S. Pat. No. 4,858,532). This latter warhead type is provided with its own target seeker which, while warheads fall towards the ground under retarded fall, scan ground level for combat-worthy targets against which the target seeker discharges, in such an event, the effective charge of the war head. The war head type is in fact generally conveyed to the target area by an artillery shell from which it is ejected at a position adapted in relation to the target, but it could also be conveyed to the proximity of the target area by a capsule in the form of a cruise missile provided with its own target seeker. The target seeker determines when it is to eject a number of warheads which then, in predetermined ejection trajectories, are spread over the assumed position of the target in order, during the downwardly directed sections of each respective ejection trajectory, to scan ground level for combat worthy targets.

A warhead which is separated from a capsule flying at high speed in an aerodynamic trajectory will have its own flight path which will be dependent upon the flight speed of the capsule in relation to the warhead's own ejection velocity and ejection angle. Correctly adapted to one another, these can impart to the warhead a forwardly directed ejection trajectory with desired maximum altitude and ejection length, In order that the ejection length will not be too long, it may be appropriate to make the ejection operation fire obliquely rearwardly. If the capsule moves at high velocity (as is presupposed here), a relatively high ejection velocity will be required, which entails demands for a rocket motor whose size is not negligible in relation to the warhead. It may be assumed that the capsule which, thus, must initially contain a plurality of warheads, cannot be made so stable that an ejection system of the gun type could be usable.

Since the ejection rocket motor will have a certain size in relation to the warhead, it must be removed from the warhead as soon as it is no longer needed, i.e. as soon as it has burnt out. Otherwise, it will influence the ejection trajectory of the warhead, which desirable.

SUMMARY OF THE INVENTION

The object of the present invention is to devise an extremely simple solution to these problems.

The invention, which has otherwise been defined in the appended claims, is thus based on the concept that the communication between the warhead and the rocket motor is such that the aerodynamic forces and inertia forces acting on these units bleak down this connection as soon as the rocket motor has burnt out and no longer acts on the warhead in the flight direction. This fundamental principle (which is illustrated in the accompanying drawings) may thus consist of a loose lap joint in the form of concentric ring edges of relatively low height disposed inside one another.

BRIEF DESCRIPTION OF THE DRAWINGS

The present invention will now be described in greater detail hereinbelow, with particular reference to the accompanying Drawings. In the accompanying Drawings.

DETAILED DESCRIPTION OF PREFERRED EMBODIMENT

Figure 1:
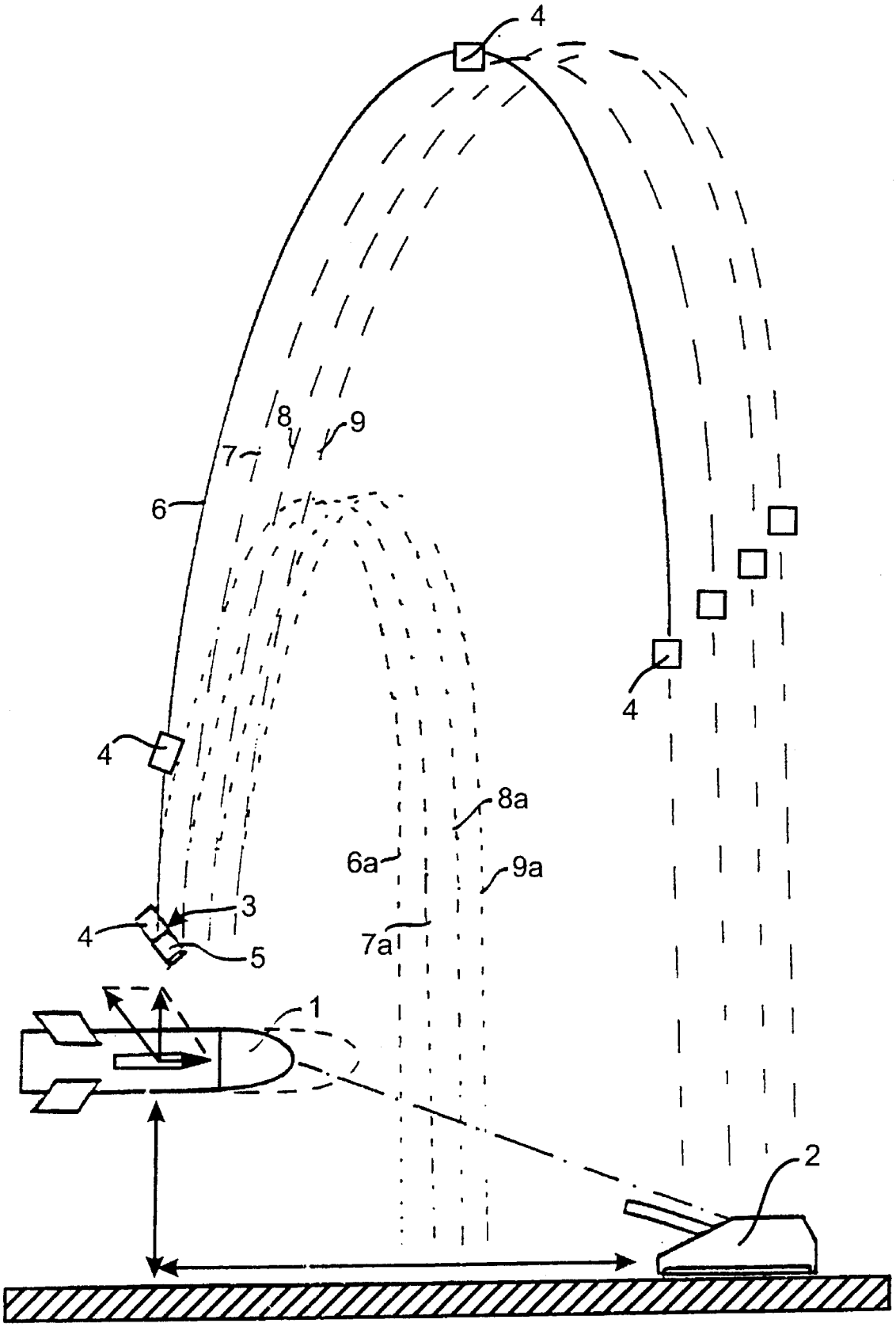
FIG. 1 shows a fundamental concept for the employment of warheads of the type contemplated here.
Figure 2:
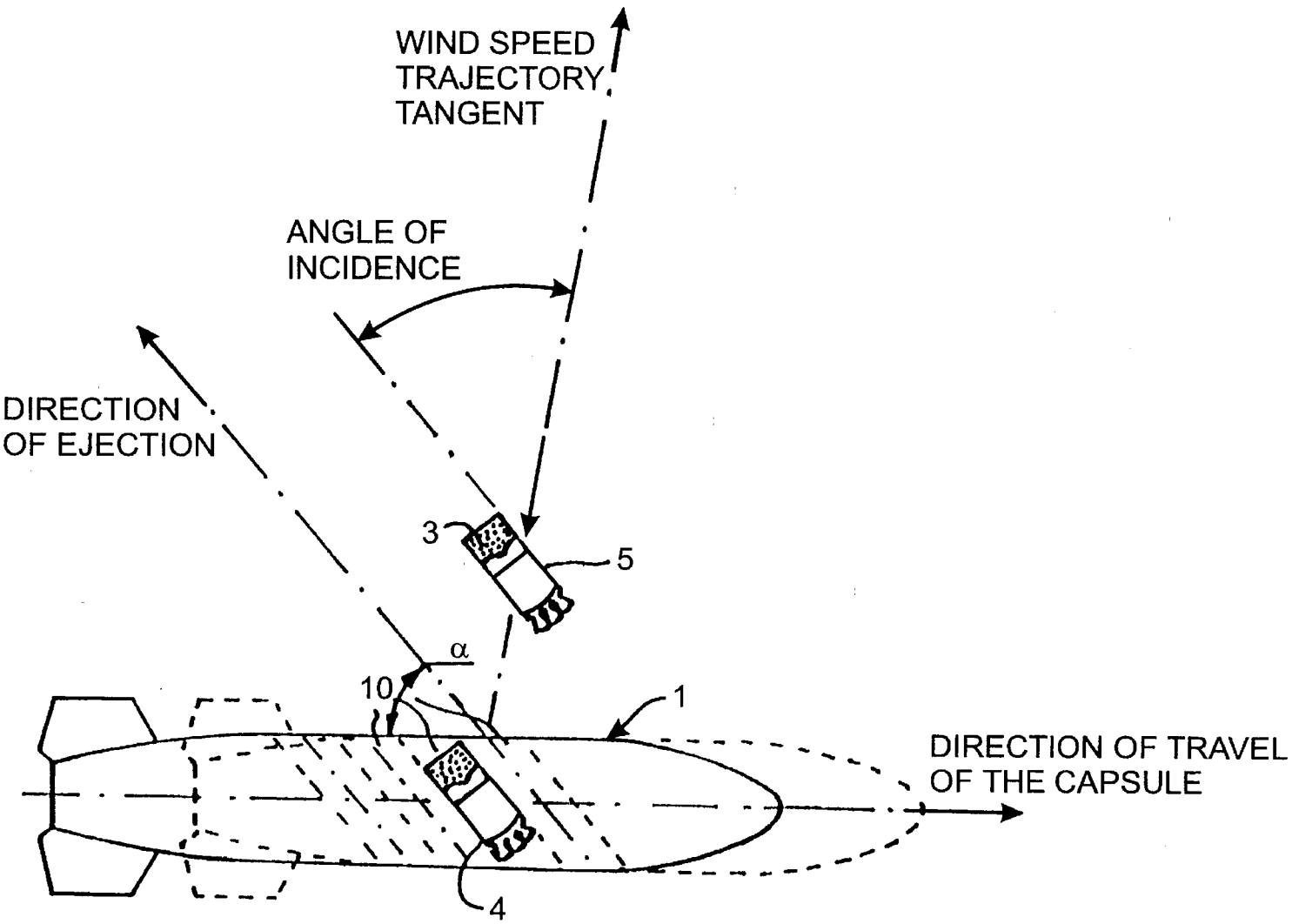
FIG. 2 shows the variables determinative of the launching process.

The capsule 1 illustrated in FIG. 1 is on its in-flight path towards the target 2. When the target seeker of the capsule has identified the target 2, the capsule begins to eject complete warhead 3. These consist of actual warheads 4 and rocket motors 5. On the figure, the ballistic ejection trajectories 6–9 are intimated for 4 warheads ejected in sequence one after another. The trajectories or the rocket motors have been marked *6a–9a* in a corresponding manner. If the ejection is made progressively during flight, there will be obtained, as is apparent from the figure, an elongate blanket cover at ground level. Lateral cover is realized by the ejection tubes 10 of the capsule being given slightly different lateral directions. The different variables determinative 2 of the ejection trajectory of the capsule are intimated in FIG. 4.

Figure 3:
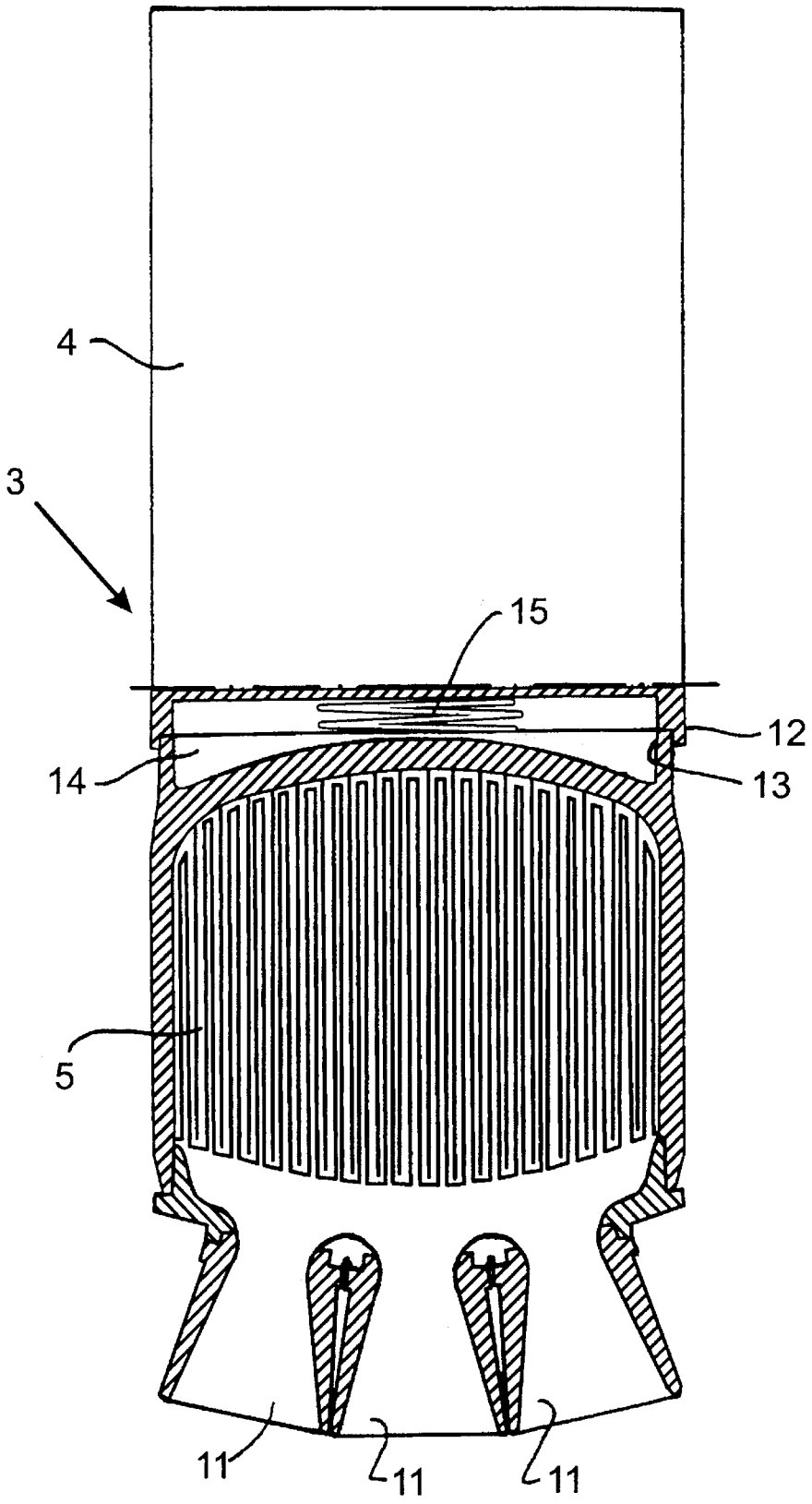
FIG. 3 shows, partly in cross section, a war head and its rocket motor.
Figure 4:
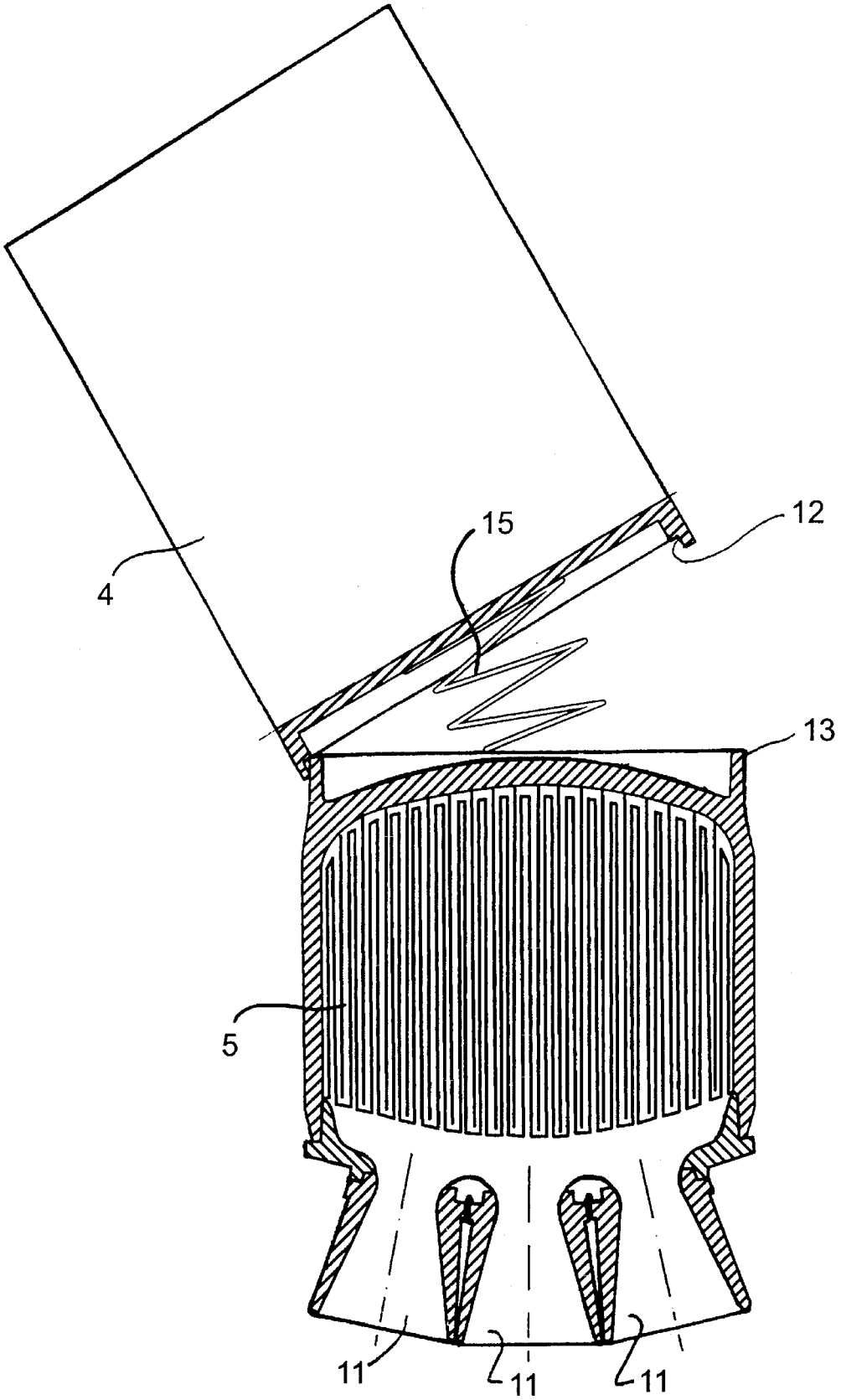
FIG. 4 shows the same details as in FIG. 3, but once the separation between the parts has been commenced.

The complete warhead 3 shown on a larger scale in FIGS. 3 and 4 thus includes the actual warhead 4, whose details are of no significance here and will, therefore, not be considered, as well as the rocket motor 5. This latter is of the high efficiency type, but with a very short burn time. The trajectory which is illustrated in the figure has, for example, seven outlet nozzles 11. The connection between the warhead 4 and the rocket motor 5 consists, as is apparent from the figure, solely of a low cylindrical outer edge 12 to the warhead 4 which surrounds and lies concentrically outside a corresponding annular edge 13 in the edge of the rocket motor 5 facing towards the warhead. As long as these pairs are located in the capsule, they are held together by the adapted ejection tube 10, while, as soon as the rocket motor 5 has been started, they are kept together by the compression acceleration with which the motor acts on the warhead 4.

When the burn time of the rocket motor is completed (which takes place when the complete warhead is located a few meters above the capsule), the aerodynamic forces will, act against the warhead 4 and the rocket motor 5, respectively, and break apart these sections which will thereafter follow their own trajectories. The angle at which the aerodynamic forces act is determined by the ejection angle E which, in turn, is adapted to the flight speed of the capsule and the ejection velocity of the complete warhead 3. By adaptation of these variables to one another, the warhead proper can thus be given a suitable ejection trajectory towards the target 2 indicated by the target seeker of the capsule 1.

The aerodynamic forces act on the rocket motor 5 and warhead 4, respectively, in such a manner that momentary forces occur with the center of rotation in the plane division between the locket motor and the warhead so that a division process according to FIG. 4 is started. After the division, the locket motor and warhead, respectively, will each have their different ballistic trajectories since they are of different masses and possess different coefficients of resistance.

In order to facilitate the separation of these two, a resilient packing 15 or the like could be applied in the space 14 between the rocket motor 5 and the warhead 4 as is shown in FIGS. 3 and 4.

The present invention should not be considered as restricted to that described above and shown on the Drawings, many modifications being conceivable without departing from the spirit and scope of the appended claims.

We claim:

1. A method of separating a warhead to be delivered to a target from a carrier missile carrying warheads therein and flying at high speed in a first aerodynamic trajectory, said method comprising the steps of:

ejecting said warhead from said carrier missile rearwardly and upwardly at an oblique angle to said first aerodynamic trajectory to a desired second aerodynamic trajectory by means of a rocket motor connected therewith, the ejection velocity of said rocket motor and said warhead being adjusted in relation to the flight speed of the carrier missile to achieve said desired second trajectory, said second aerodynamic trajectory having a substantially higher maximum flight altitude above ground level than that of said first trajectory; and separating said rocket motor,.after it has burned out, from said warhead by aerodynamic forces acting on said motor and said warhead whereby said motor and said warhead each follow their own forward trajectories, said aerodynamic forces being created from the angle of ejection of said warhead from the carrier missile and the relative flight velocities of said warhead and the carrier missile.

2. The method according to claim 1, further comprising the step of housing said warhead and said rocket motor together in an ejection tube prior to the ejection step.

3. The method according to claim 1, further comprising the step of connecting said rocket motor to said warhead by a loose overlap joint connection prior to the separation step.

4. The method according to claim 3, wherein the area of said joint determines the separation time after the burnout of said rocket motor.

5. The method according to claim 1, further including positioning of a resilient washer between said rocket motor and said warhead to facilitate the separation step.

6. A method according to claim 1, wherein the ejection direction of the warhead is rearwardly directed in the flight direction of the missile such that the resulting velocity between the velocity of the missile and the ejection velocity of the rocket motor provides a forwardly directed trajectory to the warhead.

7. An apparatus for separating a warhead to be delivered to a target from a carrier missile flying at high speed in a first aerodynamic trajectory, comprising:

a rocket motor releasably connected to said warhead in said carrier missile;

an ejection tube, positioned obliquely in the carrier missile rearwardly and upwardly with respect to a longitudinal axis of said carrier missile, from which said warhead is ejected from the carrier missile by said rocket motor rearwardly and upwardly at an oblique angle to the first aerodynamic trajectory into a desired second aerodynamic trajectory, said second trajectory having a substantially higher maximum flight altitude than said first trajectory; and means for providing said releasable connection between said warhead and said rocket motor after ejection by aerodynamic forces created from the angle of ejection of the warhead from the carrier missile and the relative flight speeds of said warhead and carrier missile, and allows separation of said motor and said warhead upon burning of said motor so that said motor and said warhead follow separate forward trajectories.

8. An apparatus according to claim 7, further comprising a resilient washer disposed between said rocket motor and said warhead prior to separation of said motor and said warhead, for imparting an extra impulse to the separation of said rocket motor and said warhead upon burnout of said rocket motor.

* * * * *